United States Patent [19]

Seynhaeve

[11] Patent Number: 4,463,840

[45] Date of Patent: Aug. 7, 1984

[54] WHEELED SUITCASE

[75] Inventor: André G. Seynhaeve, Senlis, France

[73] Assignee: Societe Delsey, Bobigny, France

[21] Appl. No.: 467,515

[22] Filed: Feb. 18, 1983

[30] Foreign Application Priority Data

Feb. 24, 1982 [FR] France ..... 82 03046

[51] Int. Cl.[3] ..... A45C 5/14; B60B 33/00

[52] U.S. Cl. ..... 190/18 A; 16/18 R; 16/29; 16/45

[58] Field of Search ..... 190/18 A, 18 R; 16/18 R, 29, 45

[56] References Cited

U.S. PATENT DOCUMENTS

| | | | |
|---|---|---|---|
| 3,163,268 | 12/1964 | Leavell | 190/18 A |
| 4,069,543 | 1/1978 | James | 16/18 R |
| 4,244,452 | 1/1981 | Seynhaeve | 190/18 A |
| 4,321,727 | 3/1982 | Sheiman et al. | 190/18 A |

FOREIGN PATENT DOCUMENTS

| | | | |
|---|---|---|---|
| 2641272 | 3/1977 | Fed. Rep. of Germany | 16/45 |
| 1316415 | 12/1962 | France | 16/45 |

*Primary Examiner*—William Price
*Assistant Examiner*—Sue A. Weaver
*Attorney, Agent, or Firm*—Roylance, Abrams, Berdo & Goodman

[57] ABSTRACT

A wheeled suitcase is provided in which each of the wheels (6) comprises a cylindrical running strip (13) integral with a central hub (14) having an external annular rib (15), a support (16) comprising studs (17) spaced at equal distances from a bore (18) coaxial with the hub and each ending in a radial lug (19) under which the rib (15) of the hub fits and a shaft (20) passing through the bore (18) of the support to penetrate inside the hub (14), one of the ends of this shaft bearing a plate (21) applied against the face of the support (16) which is opposite the studs (17) whereas its other end comprises an annular groove (22) cooperating with a complementary annular rib (23) formed inside the hub, means (32) being provided for securing the plate (21) and the support (16) inside the housing (7) formed in the external face of the corresponding shell (1).

8 Claims, 3 Drawing Figures

WHEELED SUITCASE

The present invention relates to a suitcase comprising two shells and at least two wheels disposed in housings provided in the external face of at least one shell, so as to project outwardly.

The wheels which are to be found at the present time on certain suitcases are formed from relatively numerous and complex parts. Now, since these parts are in general difficult to produce and time-consuming to assemble, the cost of manufacturing and assembling them appreciably increases the cost price of present-day wheeled suitcases.

The present invention proposes remedying this disadvantage and, for this, it provides a wheeled suitcase which is characterized in that each wheel comprises a cylindrical running strip integral with a central hub provided with an external annular rib, a support comprising studs situated at equal distances from a bore coaxial with the hub and each ending in a radial lug under which the rib of the hub fits, and a shaft passing through the bore of the support to penetrate inside the hub, one of the ends of this shaft carrying a plate applied against the face of the support which is opposite these studs whereas its other end comprises an annular groove cooperating with a complementary annular rib formed inside the hub, means being provided for securing the plate and the support inside the housing provided in the external face of the corresponding shell.

Such wheels are only formed from three parts and so have a particularly simple structure. They are further easy to assemble since to interlock their three component parts, it is sufficient to push the shaft sufficiently far into the hub for its groove to cooperate with the rib formed in the inner face of said hub.

Securing the wheels to the shells of suitcases can moreover be achieved in an extremely simple way, as will be seen hereafter.

Other features and advantages of the present invention will become clear from the description of a particular embodiment, which will be given hereafter by way of non limiting example, with reference to the accompanying drawings in which.

Figure 1:
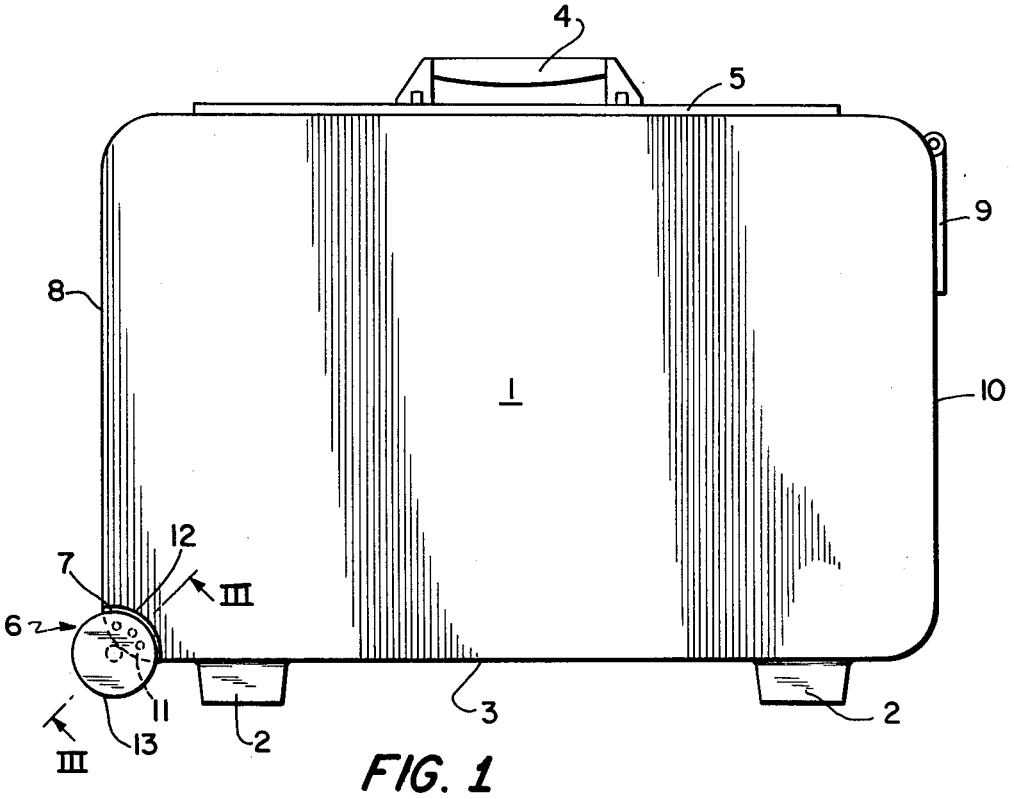
FIG. 1 is a schematical elevational view of a suitcase in accordance with the invention.

The suitcase which is shown in FIG. 1 comprises, in a way known per se, two shells (only one of which is visible under the reference 1) formed preferably from plastics material, feet 2 projecting from its lower longitudinal face 3, a carrying handle 4 projecting from its upper longitudinal face 5, two wheels 6 each disposed in a housing 7 formed in the large faces of the shells, at the level of the intersection of the lower face 3 and the lateral face 8 thereof and a pulling handle 9 pivotably mounted to the upper part of the other lateral face 10 thereof.

Wheels 6, whose external surface is practically in the extension of the large face of the corresponding shell (see FIG. 3), project from faces 3 and 8 of the suitcase, so as to come into contact with the ground only when the user raises the suitcase by means of the pulling handle 9.

As for the housings 7 of the wheels, they comprise first of all a flat bottom 11 parallel to the median longitudinal plane of the suitcase and having a convex front edge whose curvature corresponds to that of the junction zone between faces 3 and 8. They also comprise a cylindrical lateral wall 12 perpendicular to the bottom 11 thereof and whose radius of curvature, centered at a point situated slightly in front of the junction zone of faces 3 and 8, is slightly larger than that of the corresponding wheel 6.

In accordance with the invention, each wheel 6 comprises a cylindrical running strip 13 integral with a central hub 14 (illustrated in FIG. 3) provided with an external annular rib 15, a support 16 comprising studs 17 spaced at equal distances from a bore 18 coaxial with the hub 14 and each ending in a radial lug 19 under which the rib 15 of the hub fits, and a shaft 20 passing through the bore 18 before penetrating inside the hub 14, one of the ends of shaft 20 carrying a plate 21 applied against the face of support 16 which is opposite studs 17 whereas its other end comprises an annular groove 22 cooperating with a complementary annular rib 23 formed inside the hub.

The running strip 13 is connected to the central hub 14 through a circular web 24 closing its external end and radial webs 25 (illustrated in FIG. 3) projecting from the inner face of web 24.

Figure 3:
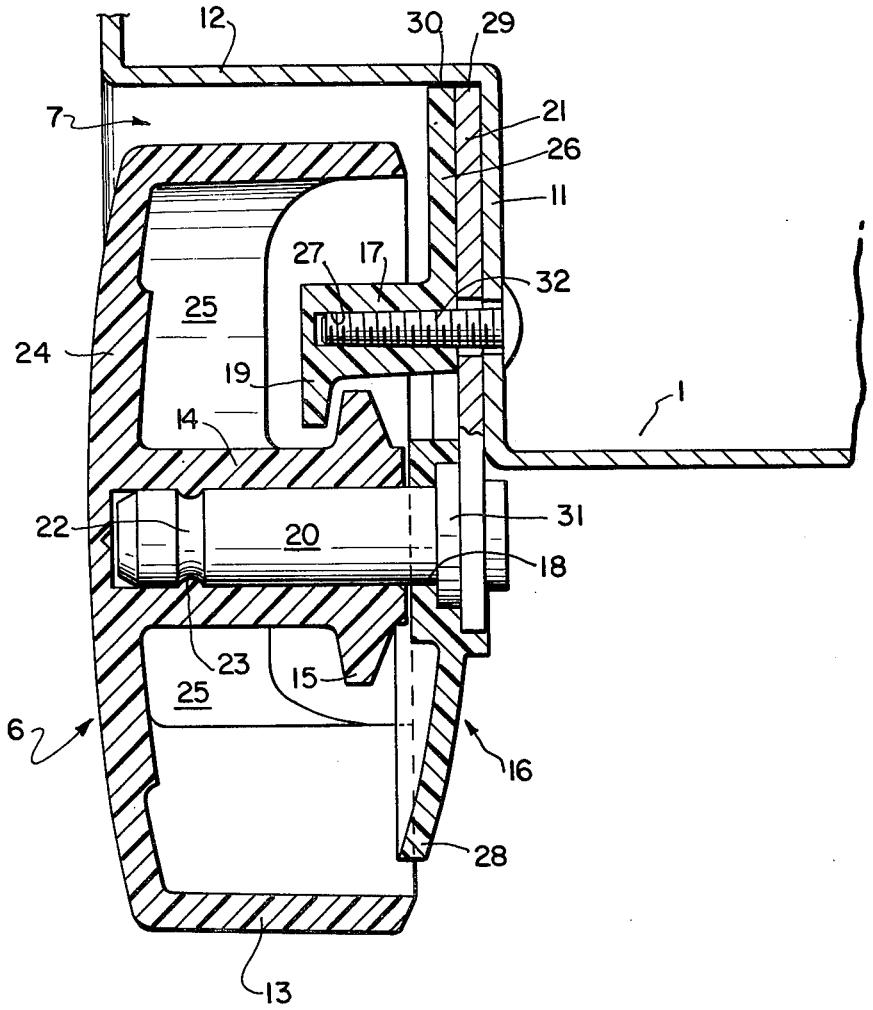
FIG. 3 is an enlarged sectional view taken along line III—III of FIG. 1.

Referring in particular to FIG. 3, it will be noted that the rib 15 of hub 14 is situated proximate the free end thereof and that the running strip forms with the hub an integrally molded part, preferably from a plastics material.

Figure 2:
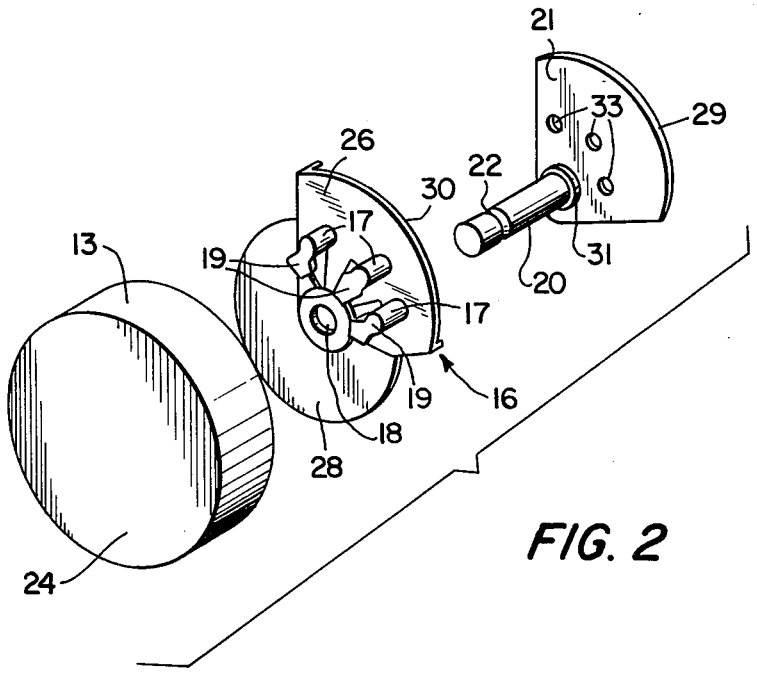
FIG. 2 is an exploded perspective view showing the wheel illustrated in FIG. 1.

Support 16 in the embodiment envisaged here comprises three equidistant studs 17 which are situated inside a flat sector 26 centered on the axis of bore 18 and not projecting from the faces 3 and 8 of shell 1, this sector having an angle at the center of about 90° (see in particular FIG. 2). Naturally, support 16 could comprise a larger number of studs, providing however that rib 15 of the hub may be fitted between the endmost studs.

As can be seen in FIG. 3, each of studs 17 is provided with a longitudinal cavity 27 whose entrance opens into the face of sector 26 which is turned towards the bottom 11 of the housing 7 of the wheel.

Support 16 also comprises a circular section 28 centered on the axis of bore 18 and situated opposite the flat sector 26. This circular section has a radius slightly less than the inner radius of the running strip and is slightly curved towards web 24 (see FIG. 3). It extends over an arc of a circle substantially equal to that which is defined by the part of the wheel projecting from housing 7 and which corresponds to an angle at the center of about 270°.

Just like the running strip 13 and hub 14, support 16 is preferably formed from a molded plastics material.

Referring to the drawings, it will be further noted that the plate 21 of shaft 20 of the wheel extends over a sector whose angle at the center is about 90° and that its circular periphery 29, like moreover the circular periphery 30 of the flat sector 26 of the support 16, is applied against the lateral wall 12 of housing 7 when the wheel is in position.

It will also be noted that shaft 20 comprises, at the level of its connection with plate 21, a boss 31 disposed in a corresponding widened portion of bore 18. Referring more particularly to FIG. 3, it will finally be noted that shaft 20 alone holds in position, by means of its groove 22 and its boss 31, the assembly of the running strip 13 and support 16.

To give the wheel sufficient strength, shaft 20 and its plate 21 are preferably made from metal.

Assembling wheel 6 is extremely simple. It is in fact sufficient to bring together support 16 and hub 14 so that the lugs 19 of studs 17 ride over the rib 15 of the hub and then introduce shaft 20 into bore 18 until its groove 22 engages with rib 23 of the hub, plate 21 then being applied against the face of the flat sector 26 which is opposite stud 17.

The complete introduction of the shaft may be advantageously provided by force fitting which poses no technical problem and further guarantees a reliable assembly.

It will be noted from FIG. 3 that the curved web 28 closes off the internal end of the running strip and consequently prevents dirt and other foreign bodies from penetrating inside the wheel.

As for securing the wheel in its housing 7, it is achieved in an extremely simple way since it only requires three screws 32 (or any other similar elongated means) whose heads bear against the internal face of bottom 11 of the housing and whose shanks pass through the shell of the suitcase and into holes 33 provided in the plate 21 of shaft 20 before being screwed into the longitudinal cavities 27 of studs 17.

In the embodiment which has just been described, the wheels are borne by two shells of the suitcase. It goes however without saying that they could both be mounted in the same shell, their shaft then being not perpendicular but parallel to the large faces of the shells. The suitcase could of course, if need be, comprise four wheels such as those which have just been described.

I claim:

1. A suitcase comprising two shells and at least two wheels disposed in housings provided in the external face of at least one shell, so as to project outwardly, characterized in that each wheel (6) comprises a cylindrical running strip (13) integral with a central hub (14) having an external annular rib (15), a support (16) comprising studs (17) spaced at equal distances from a bore (18) coaxial with the hub and each ending in a radial lug (19) under which the rib (15) of the hub fits, and a shaft (20) passing through the bore (18) of the support to penetrate inside the hub (14), one of the ends of this shaft carrying a plate (21) applied against the face of the support (16) which is opposite the studs (17) whereas its other end comprises an annular groove (22) cooperating with a complementary annular rib (23) formed inside the hub, means (32) being provided for securing the plate (21) and the support (16) inside the housing (7) provided in the external face of the corresponding shell (1).

2. The suitcase as claimed in claim 1, characterized in that the running strip (13) is connected to the hub (14) by means of a circular web (24) closing one of its ends and radial webs (25) projecting from the inner face of the circular web (24), the central hub (14) carrying the external annular rib (15) at its free end.

3. The suitcase as claimed in claim 2, characterized in that the support comprises three equidistant studs (17) situated inside a sector (26) centered on the axis of the bore (18) and presenting an angle at the center of about 90°, the plate (21) of the shaft (20) having dimensions substantially equal to those of this sector (26) whereas each of the studs (17) is provided with a longitudinal cavity (27) whose entrance opens in front of a bore (33) formed in the plate (21) of the shaft (20).

4. The suitcase as claimed in claim 3, characterized in that the means for securing the plate (21) and the support (16) inside the housing (7) are formed by screws (32) whose heads bear against the inner face of the shell (1) and whose shanks are fitted into holes formed in the shell, as well as into the bores (33) of the plate (21) and are held in the longitudinal cavities (27) of the studs (17).

5. The suitcase as claimed in claim 4, characterized in that the support (16) comprises a circular section (28) centered on the bore (18) of the support (16) and opposite the sector (26) in which the studs (17) are situated, this circular section (28) having a radius slightly less than the inner radius of the running strip (13) and being slightly curved so that it closes off this latter.

6. The suitcase as claimed in claim 1, characterized in that the support comprises three equidistant studs (17) situated inside a sector (26) centered on the axis of the bore (18) and presenting an angle at the center of about 90°, the plate (21) of the shaft (20) having dimensions substantially equal to those of this sector (26) whereas each of the studs (17) is provided with a longitudinal cavity (27) whose entrance opens in front of a bore (33) formed in the plate (21) of the shaft (20).

7. The suitcase as claimed in claim 6, characterized in that the means for securing the plate (21) and the support (16) inside the housing (7) are formed by screws (32) whose heads bears against the inner face of the shell (1) and whose shanks are fitted into holes formed in the shell, as well as into the bores (33) of the plate (21) and are held in the longitudinal cavities (27) of the studs (17).

8. The suitcase as claimed in claim 7, characterized in that the support (16) comprises a circular section (28) centered on the bore (18) of the support (16) and opposite the sector (26) in which the studs (17) are situated, this circular section (28) having a radius slightly less than the inner radius of the running strip (13) and being slightly curved so that it closes off this latter.

* * * * *